United States Patent [19]

Arimond

[11] Patent Number: 4,705,464

[45] Date of Patent: Nov. 10, 1987

[54] MEDICINE PUMP

[75] Inventor: Timothy V. Arimond, St. Louis Park, Minn.

[73] Assignee: Surgidev Corporation, Goleta, Calif.

[21] Appl. No.: 861,366

[22] Filed: May 9, 1986

[51] Int. Cl.[4] ..... F04B 43/12

[52] U.S. Cl. ..... 417/477

[58] Field of Search ..... 417/476, 477

[56] References Cited

U.S. PATENT DOCUMENTS

| | | | |
|---|---|---|---|
| 3,137,242 | 6/1964 | Hahn | 417/477 |
| 3,756,752 | 9/1973 | Stenner | 417/477 |
| 4,185,948 | 1/1980 | Maguire | 417/477 |
| 4,210,138 | 7/1980 | Jess et al. | 417/477 |
| 4,500,269 | 2/1985 | Jess | 417/476 |
| 4,527,323 | 7/1985 | Dawson | 417/477 |
| 4,606,710 | 8/1986 | Maguire | 417/477 |

FOREIGN PATENT DOCUMENTS

| | | | |
|---|---|---|---|
| 628785 | 9/1949 | United Kingdom | 417/477 |

*Primary Examiner*—Leonard E. Smith

*Attorney, Agent, or Firm*—Hugh D. Jaeger

[57] ABSTRACT

Low power peristaltic medicine pump and filter for infusion of medicinal solutions. The pump includes a pump housing, a low durometer PVC pump tube; fit within an interior circular groove of the pump housing, tube slots, a rotor cavity within the walls of the pump housing bearing hole and recessed motor mounting body holes. A sealed geared motor in a motor recess in the bottom of the pump housing and a shaft and drive pin extend from the motor through a bearing hole in the pump housing to drive a pump rotor. Rotor mounted plungers offset at an angle to the radii of the pump rotor body to minimize internal friction for low power consumption and are spring loaded outwardly to depress plunger mounted rollers against the PVC pump tubing for subsequent peristalic pumping action through an inset PVC pump tube. A knurled knob loading tool positions on the pump rotor. Feed fingers attached to a circular plate on the loading tool facilitate loading of the PVC pump tube into the inner groove of the pump housing. A low durometer PVC pump tube attaches to a medical solution filter system which includes internal filter members, ribbed filter supports, hydrophobic filters, air elimination ports, a filter outlet port, a medicine bag puncturing tip, filter alignment pins, a medical solution outlet and peristaltic pump tube connection and support orifices. The peristalic pump and the filter align and are spaced on an alignment bracket on an electromechanical housing. A spring pressurized IV medicine bag in a detachable housing supplies infusate to the filter and the peristalic pump.

1 Claim, 11 Drawing Figures

MEDICINE PUMP

BACKGROUND OF THE INVENTION

1. Field of the Invention

The present invention relates to a medicine pump and, more particularly pertains to a lower power consumption peristaltic pump and filter system for medical solution and drug infusion.

2. Description of Prior Art

Prior art peristaltic pumps have all presented some type of drawbacks when manufactured or used by a physician, nurse or patient, which are particularly less than desirable. Prior art peristaltic pumps consisted largely of fixed wiper arms which necessitated construction adhering to very close tight tolerances to properly occlude the infusion set. Prior art also includes spring loaded wiper arms which were simply mounted paralleled or along the radii of the rotor hub and in both of the above cases, prior art used a roller at the end of the wiper arm to minimize friction between the wiper arm and the infusion set. It is generally recognized that prior art devices require a high priming volume which is detrimental to normally low volume infusaids. Other problems in prior art concern pump tube creeping, improper and high durometer tubing, accidental occlusion, and inaccurately adding ministered dosages of medical solutions.

Prior art pump filter air elimination systems are generally position sensitive and special notice of physical alignment was required for proper filter function. The present invention overcomes the disadvantages of the prior art devices by providing a peristaltic pump and filter which provides for minimal power usage through the use of minimal frictional loaded pumping rollered wipers fo the infusion of medical substances and which also provides for a filtration system much less sensitive to physical orientation then prior art filters.

SUMMARY OF THE INVENTION

The general purpose of the present invention is to provide a low volume power usage peristaltic pump having a low friction angularly mounted rollered wiper or plunger bars rotating in a pump rotor against a low durometer PVC pump tube to deliver accurate amounts of filtered medical infusate solutions.

According to one embodiment of the present invention there is provided a pump body with an inner annular groove, a PVC plastic low durometer tube entering and exiting the pump body through vertical slots and lying within the inner annular groove, a low power motor driven rotor pump head including a plurality of angularly mounted spring loaded wiper or plunger arms with mounted rollers in plunger slots which compress and roll against the plastic pump tube providing peristalic pumping action through the system. A knurled knob loading tool with a top cover and loading fingers affixes atop the pump rotor for convenient tube loading and unloading.

According to another embodiment a pump filter body provides for particle and air filtering of infusate prior to entry of infusate to the pump tube. The filter body member incorporates inner filters, inner support ribs and fluid flow valleys, hydrophobic filters and air elimination ports. A medicine bag puncturing spike provides inlet access to the filter infusate outlet fixture and pump tube fixtures mount near or on the body end portion for mounting of an infusate outlet tube and the infusate pump tube.

A significant aspect and feature of the present invention is a peristaltic pump which provides for the use of a low power consumption sealed and geared DC motor suitable for extended portable battery operation.

Another aspect and significant feature of the present invention is a motor driven pump rotor including spring loaded angular low coefficient friction mounted rollered wiper bars for full occluding of pump tubing and also virtually minimizing any creep factors.

Yet another significant feature and aspect of the drug dispensing peristaltic pump is a recessed slot, in the form of an annular groove in the pump head which in conjunction with a top cover plate member contains the pump tube in the pump housing.

Another significant aspect of the present invention is an annular groove within the pump housing which acts as a plunger roller guide.

Another significant aspect of the present invention is a loading tool which facilitates ready loading and unloading of the pump tube, by the use of loading fingers, into the inner annular groove and subsequent containment of the tube therein thereafter.

Another significant aspect of the present invention is a pump filter including filter support ribs and infusate flow ribs within the body of the filter.

Another significant aspect of the present invention is a pump filter including a infusate medicine bag puncturing spike device for delivering of infusate through the filter and pump.

Another significant aspect and feature of the drug dispensing pump is a filter mounted pump tube allowing for adjacent positioning of the filter to the pump housing and precise location of pump tubing within the pump housing.

Yet another significant aspect and feature of the drug dispensing pump is a filter containing filter elements for filtration of solid particles and air, which is relatively insensitive to physical positioning.

Yet another significant aspect of the filter is a filter which provides mounting alignment pins for alignment with a pump housing of a drug dispensing system.

Yet another significant aspect and feature of the filter is a filter which provides for proper filtration in about a 270° spherical arc of movement of position, relative to gravity, of the filter housing.

Another significant aspect and feature of the peristalic pump and filter is a pressurized IV medicine bag and container assembly which readily attaches to an adjacent housing, that housing containing a peristalic pump, filter, electronic circuit board and a battery package.

Having thus described the invention, it is principal objects hereof to provide a low power consumption peristaltic pump.

One object of the present invention is to provide a filtered perisitaltic pump which requires a minimum of electrical current draw for its operation.

Another object of the present invention is to provide a filtered peristaltic pump system whose medical solution filter is usable and effective over a wide range of physical positions.

BRIEF DESCRIPTION OF THE DRAWINGS

Other objects and many of the attendent advantages of this invention will be readily appreciated as the same becomes better understood by reference to the following detailed description where considered in connection with the accompanying drawings, in which like reference numerals designate like parts throughout the figures thereof and wherein.

DESCRIPTION OF THE PREFERRED EMBODIMENTS

Figure 1:
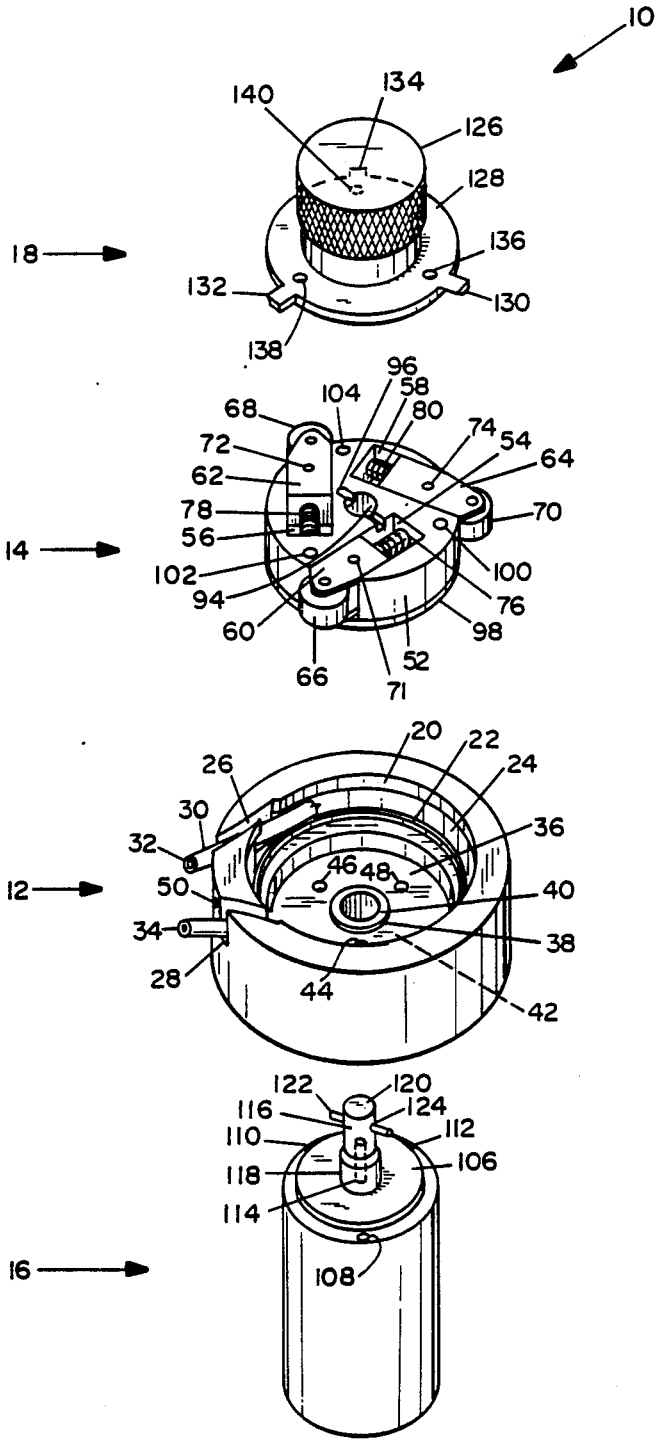
FIG. 1 illustrates a front perspective exploded view of a low power peristalic medicine pump, the present invention, including a pump housing, a pump rotor, a sealed geared motor and a loading tool.

FIG. 1 illustrates an exploded perspective view of a peristalic medicine pump 10 showing a pump housing 12, pump rotor 14, sealed geared motor 16, loading tool 18, and all associated members to be herein described.

The pump housing 12 includes upper and lower shoulder rings 20 and 22, respectively; tube groove 24 between upper and lower shoulder rings 20 and 22; input tube slot 26; output tube slot 28; plastic pump tube 30 with inlet end 32 and outlet end 34, which pass through input and output hose slots 26 and 28 and ride partially within and juxtaposed to tube groove 24; a rotor cavity 36; bearing hole 38 and bearing 40; motor head recess 42; recessed motor mounting holes 44, 46 and 48; and microswitch actuator port 50.

Figure 2:
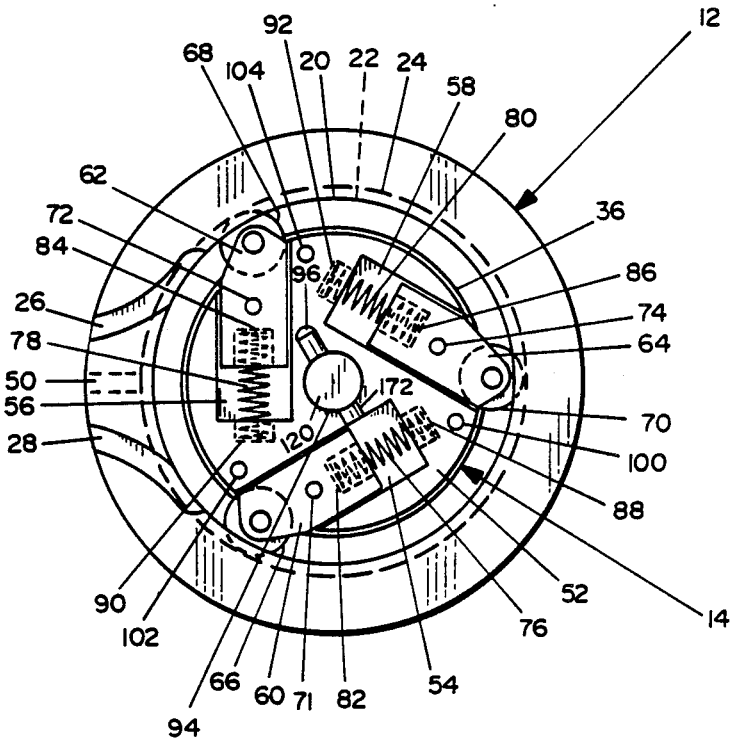
FIG. 2 illustrates a top view of the pump rotor assembly contained within the pump housing.

The clockwise rotation of the pump rotor 14 mounts within the pump housing 12 and includes the rotor body 52, plunger slots 54, 56 and 58, which are offset at an angle to the radii of the rotor body 52 for friction minimizing. Plungers 60, 62, and 64, bearing plunger rollers 66, 68, and 70, and associated pins, mount in recesses within the ends of plungers 60, 62, and 64; springs 76, 78, and 80, push outwardly on plungers 60, 62, and 64; plunger spring containment holes 82, 84, and 86 and slot end spring containment holes 88, 90, and 92, as shown in FIG. 2, shaft hole 94 and clevis pin shelf 96. Bottom cover 98 secures with machine screws from the bottom side into the bottom threaded holes 100, 102, and 104 within rotor body 52. The plungers 60–64 and the plunger rollers 66–70 push outwardly, engaging and flattening the plastic tube 30 within the tube groove 24. As the rotor body turns in a clockwise movement, fluid is moved clockwise between the portions of the tube flattened by the rollers being drawn in through inlet end 32 and expelled through outlet end 34.

The circular shoulder 106 of sealed clockwise rotation geared electric low current drawn motor 16 fits and secures within the motor recess 42 of the pump housing 12 with machine screws, not shown, through the recessed motor mounting holes 44–48 into the motor mounting holes 108, 110, and 112 correspondingly. Set pin 114 secures the dual radius drive shaft 116 to the motor shaft. Bearing shaft 118, and element of the dual radius drive shaft 116, engages frictionally within the bearing 40 of the pump housing, while the rotor shaft 120, also of dual radii drive shaft 116, engages within the shaft hole 94 of pump rotor. Clevis pin 122 mounts in clevis hole 124, and clevis pin shelf 96 insuring movement of the pump rotor 14 in a clockwise motion.

Loading tool 18 includes a knurled actuating knob 126, top cover 128, tube feed bottom radiused fingers 130, 132, and 134. Machine screws, not shown, pass through holes 136, 138, and 140 and engage the top threads of holes 100, 102, and 104 in rotary body 52 to secure the plungers 60, 62, and 64 within their respective slots 54, 56, and 58.

Figure 3:
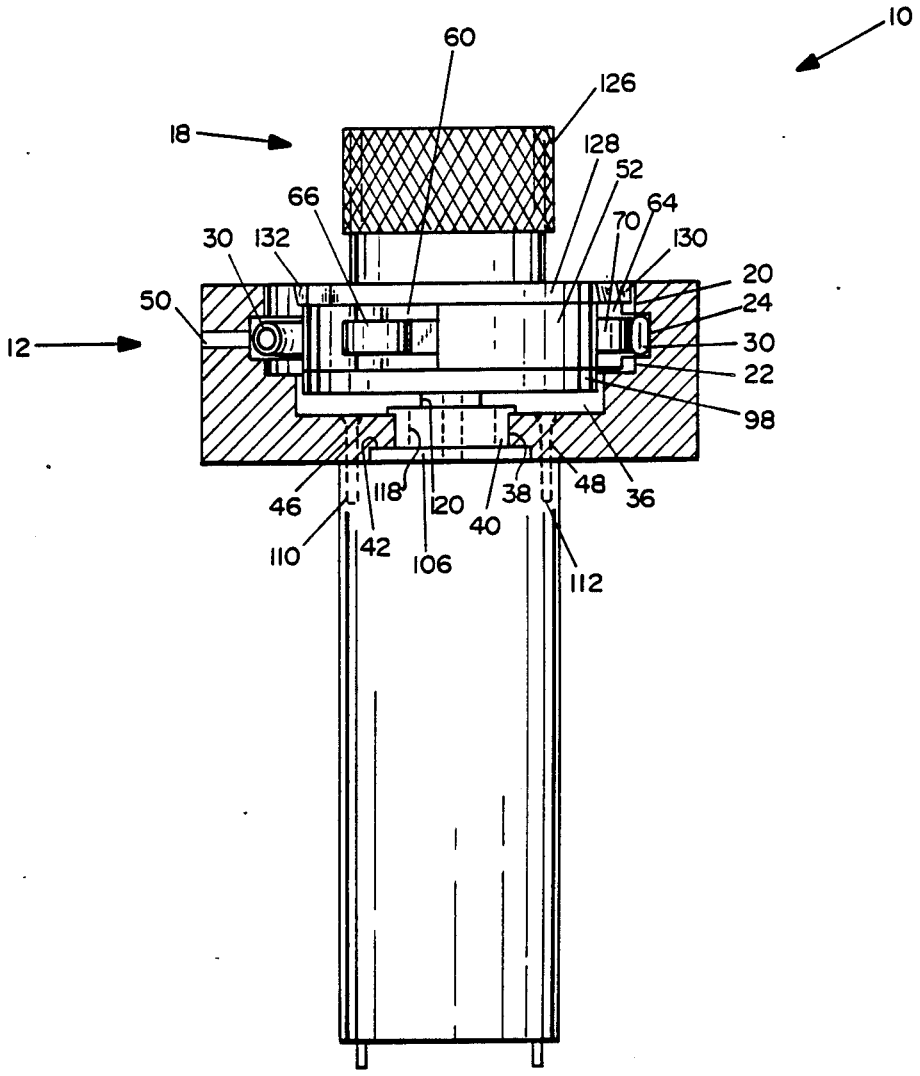
FIG. 3 illustrates a partial cross-section side view of the entire pump and motor assembly.

FIG. 2 illustrates a top view of the pump rotor assembly nested within the pump housing, where all numerals correspond to those elements previously described. Particular note is made of the uniquely mounted plungers 60–64 which are mounted in the rotor body 52 at an angle to the radius of the pump rotor body 52 in the direction of the pumping action and rotor motorization, minimizing friction between the rotor and the plungers which allows for a very low power operation and for high infusion rates. Tube groove 24 and shoulder rings 20 and 22 provide guidance for the plunger rollers 66, 68, and 70, as illustrated in this figure, and provide for capture of the plastic pump tube 30 during pumping action as seen in FIG. 3. Springs 54, 56, and 58 provide spring loading for the plungers to accommodate variances of the pump segment or tubing.

FIG. 3 illustrates a partial cross-section side view of the pump 10 where all numerals correspond to those elements previously described. Of particular note is plastic tube 30 contained within tube groove 24 and upper and lower shoulder rings 20 and 22 being compressed by the resultant action of the spring 80 upon plunger 64 and plunger roller 70 during the pumping action. A microswitch actuating port 50 allows for the roller 66-70 to actuate a microswitch probe for speed sensing and volume sensing or control of the motor and pump speed by electronic circuit board 286 of FIG. 9, and thus, a predetermined amount or dosage of medicine in a timely and controlled manner.

Figure 4:
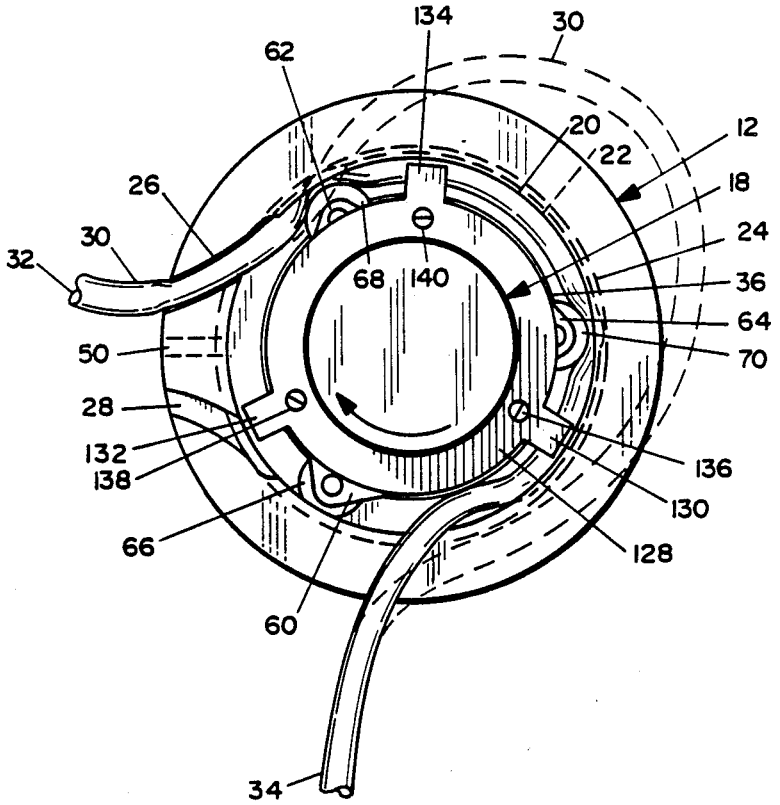
FIG. 4 illustrates a top view of the pump in the tube loading mode of operation.

FIG. 4 illustrates a top view of the pump in the loading mode of operation, which is in progress. Tube 30, a tube of sufficient length, is pressed downwardly into the input tube slot 26. A tube loading finger 130, radiused on the bottom corners, originally traversed in a clockwise direction, the area adjacent and to the right of tube slot 26, as the knurled manual actuating knob 126 was turned. As the loader finger 130 passed the tube 30, which then had a portion of it pressed into the tube slot 26 and the remainder sticking upwardly to the right of the slot, as shown in dashed lines, it pushed the tube downwardly into the tube groove 24 and continued to depress the tube 30 downwardly to its shown position in FIG. 4. As the loading finger 130 nears the output tube slot 28, the tube 30 is then simply pressed with a finger or tool into the slot 28, completing the tube loading cycle.

The loading fingers 130–134 act additionally to maintain the tube within the proper area when pump is inverted and gravity attempts to cause the tubing to fall out of tube groove 24.

Figure 5:
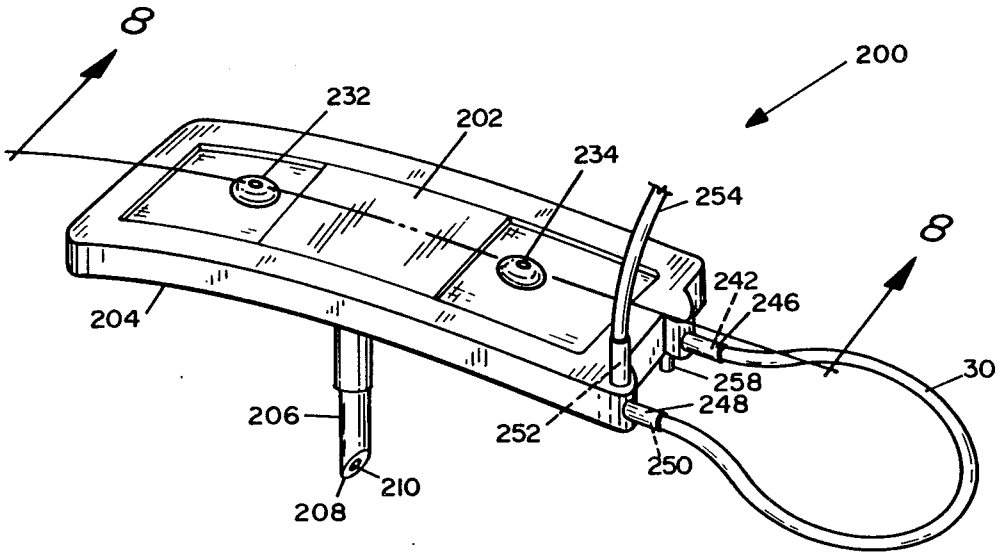
FIG. 5 illustrates a perspective view of the medical solution filter system.

FIG. 5 illustrates a perspective overall view of the medical solution filter system 200. Reference is also made to accompanying FIG. 6, 7, and 8. The filter 200 includes upper curved filter member 202 and a lower four sided curved filter member 204, a hollow spike 206 with an IV medicine bag puncturing the tip 208, a filter inlet orifice 210 and an upper spike orifice 212. The spike 206 secures into a hole 214 in the lower filter member 204, below an orifice top ring surface 216 as illustrated in FIG. 8. Ribs 218*a*–218*n*, integral with the upper surface of the lower filter body member, position longitudinally with a slight curvature conforming to that of the general filter body outline and extend almost to the ends of the cavity end walls 222 and 224, and form longitudinally valleys or gooves 219*a*–219*n* with the exception of annular groove area 226 surrounding the orifice top ring 216. A filter screen mesh 228 positions on the ribs 218*a*–218*n* and over groove area 219*a*–219*n* and annular area 226. A hole 230 in the mesh filter screen 228 corresponding to the size of the orifice top ring 216, fits down and over the orifice top ring 216 within the cavity 220. The upper filter body member 202, including air elimination ports 232 and 234 and hydrophobic filters 236 and 238, secure with a bonded joint 240 to the filter body lower member 204, forming the cavity 220. A fluted filter outlet orifice 242, having a commonalty joined with valleys 219*a*–219*n* and annular valley area 226 at the right rear end of the lower curved filter member body 204, support an end 248 of the peristaltic pump tube 30. The other end 248 of the peristalic pump tube 30 secures to the fluted pump outlet orifice 250, which is plumbed in common only with the vertical fluted orifice 252. Tube 254 conveys filtered medical solution from the pump tube 30 which fits in the tube slots 26 and 28 of the medicine pump 10 to the recipient patient. Alignment pins 256 and 258 align the entire medical solution filter system 200 to the medicine pump 10 via a common housing or mounting member, not shown, for purposes of proper alignment of the pump 30 within the pump housing 12 of the medicine pump 10.

Figure 6:
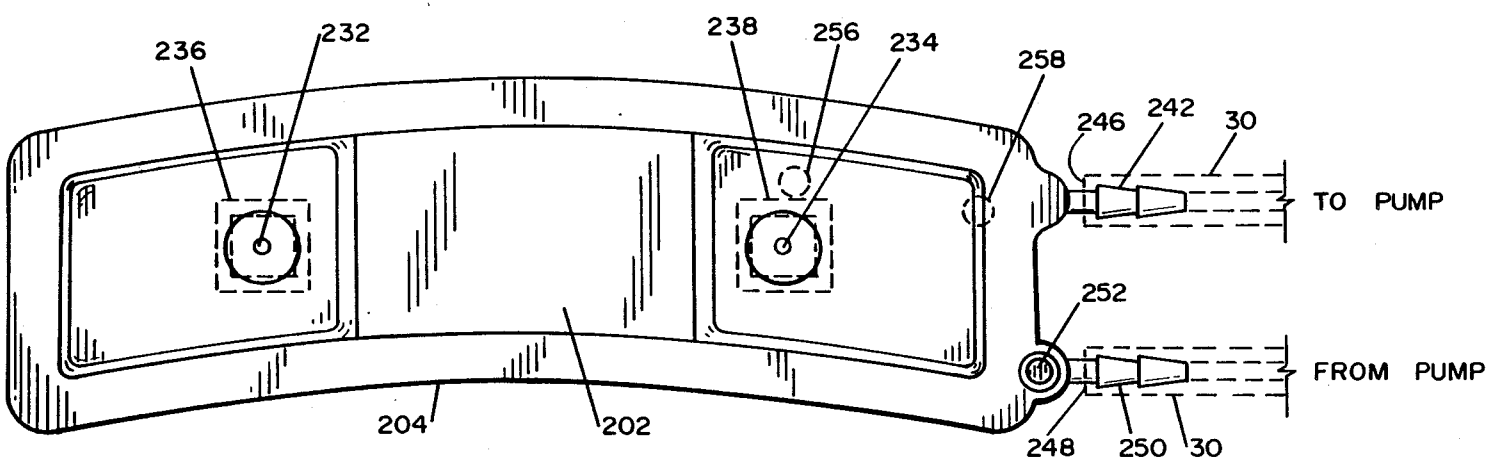
FIG. 6 illustrates a top view of the medical solution filter system.

FIG. 6 illustrates a top view of the medical solution filter system. Particularly shown is the placement of the hydrophobic filters 236 and 238 with respect to the air elimination ports 232 and 234.

Figure 7:
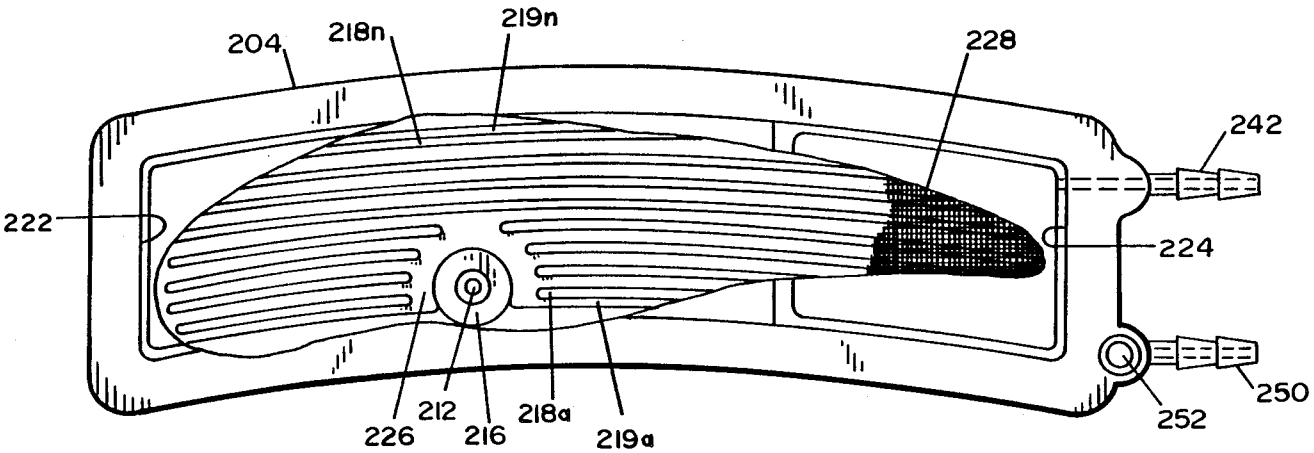
FIG. 7 illustrates a top cutaway view of the medical solution filter system.
Figure 8:
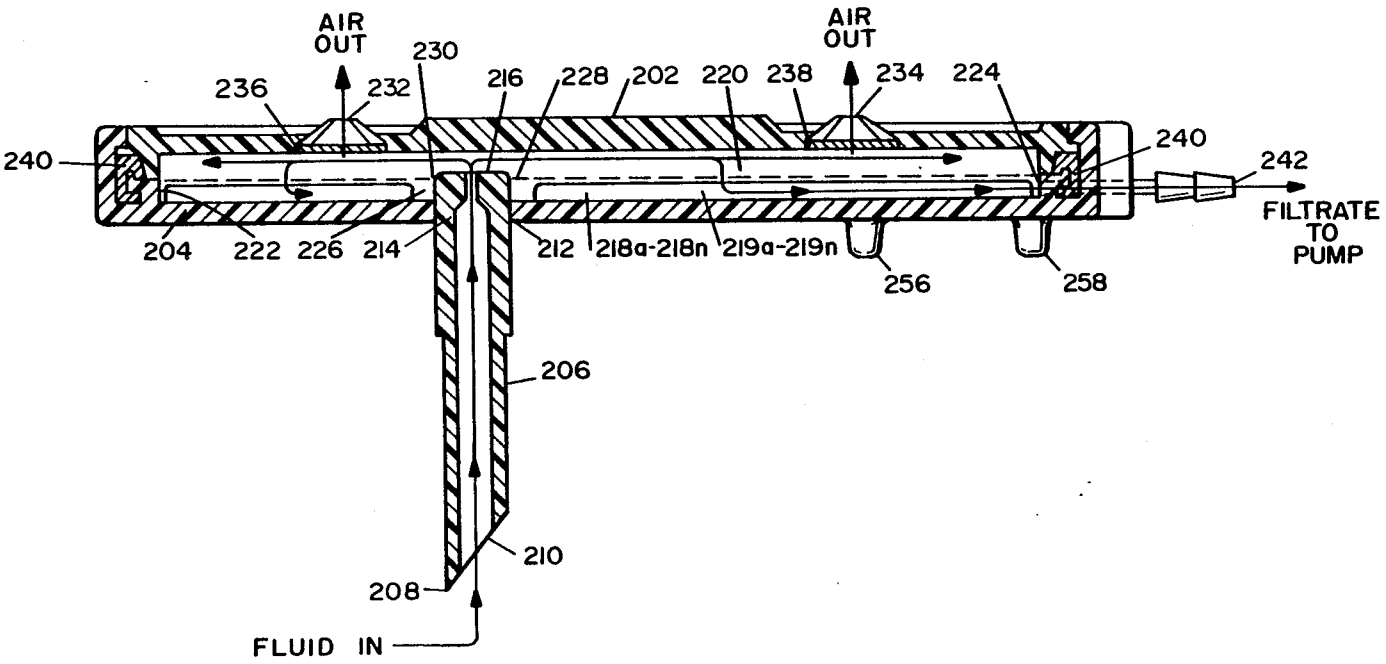
FIG. 8 illustrates a cross-sectional side view of the medical solution filter system taken along line 8—8 of FIG. 5, with particular reference to medical solution flow.

FIG. 7 illustrates a cutaway top view of the medical solution filter showing the ribs 218*a*–218*n*, valleys 219*a*–219*n*, the upper orifice hole 212, the annular groove and the overyling mesh screen filter 228.

FIG. 8 illustrates a cross-sectional longitudinal side view of the medical filter system 200 taken along line 8—8 of FIG. 5. Particularly shown are the medical solution and air flow paths. Fluid from the IV bag passes through the filter inlet orifice 210, through the upper spike orifice 212, laterally through the cavity 220, through the mesh screen filter 228, through and along valleys 219*a*–219*n* and annular area 226, through the filter outlet orifice 242 to pump 10 described previously. Any air in the cavity 220 is expelled through hydrophobic filters 236 and 238 through air elimination ports 232 and 234, respectively.

Figure 9:
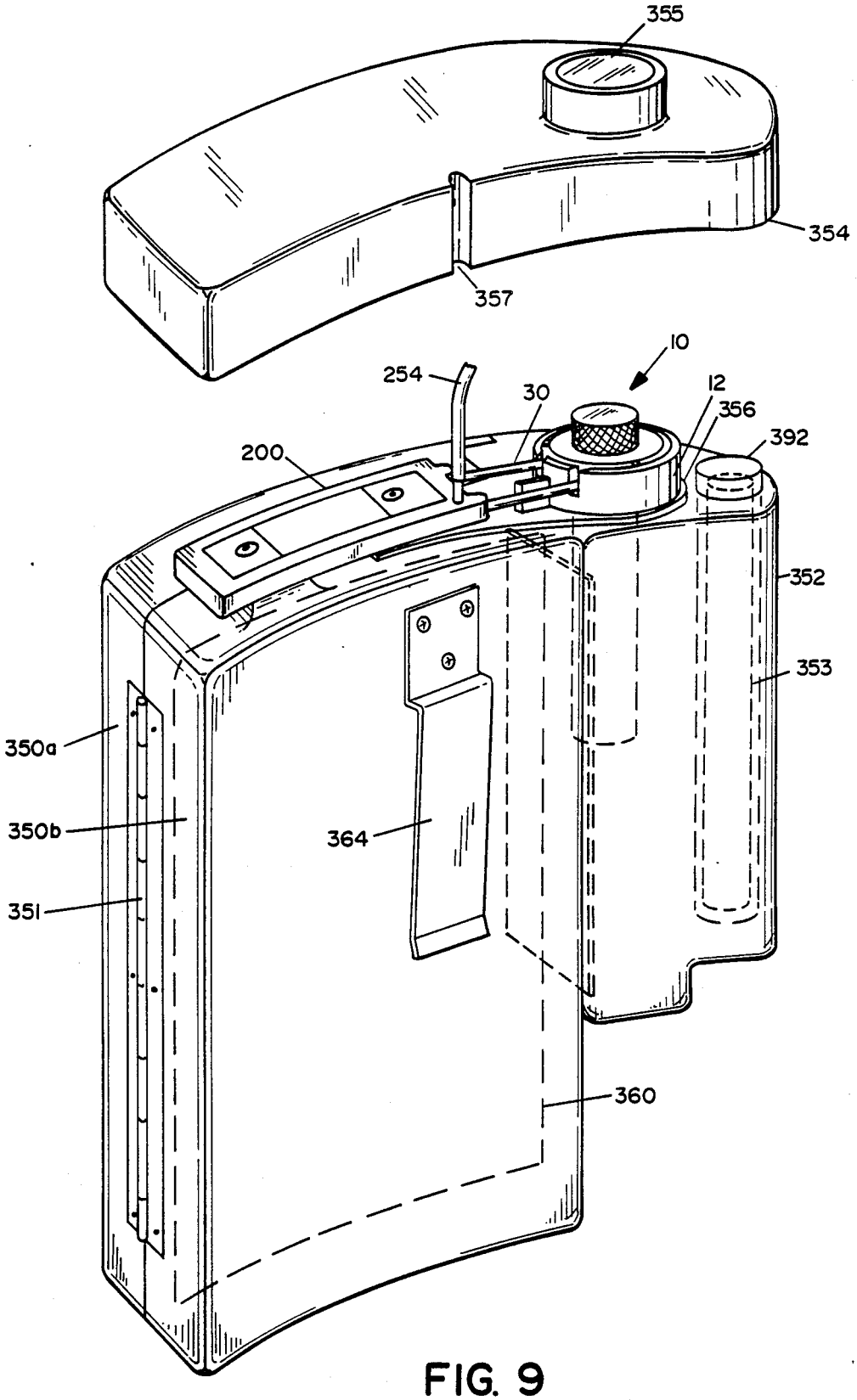
FIG. 9 illustrates in perspective a view of the IV medicine bag housing and attached electromechanical housing with the cover detached.
Figure 10:
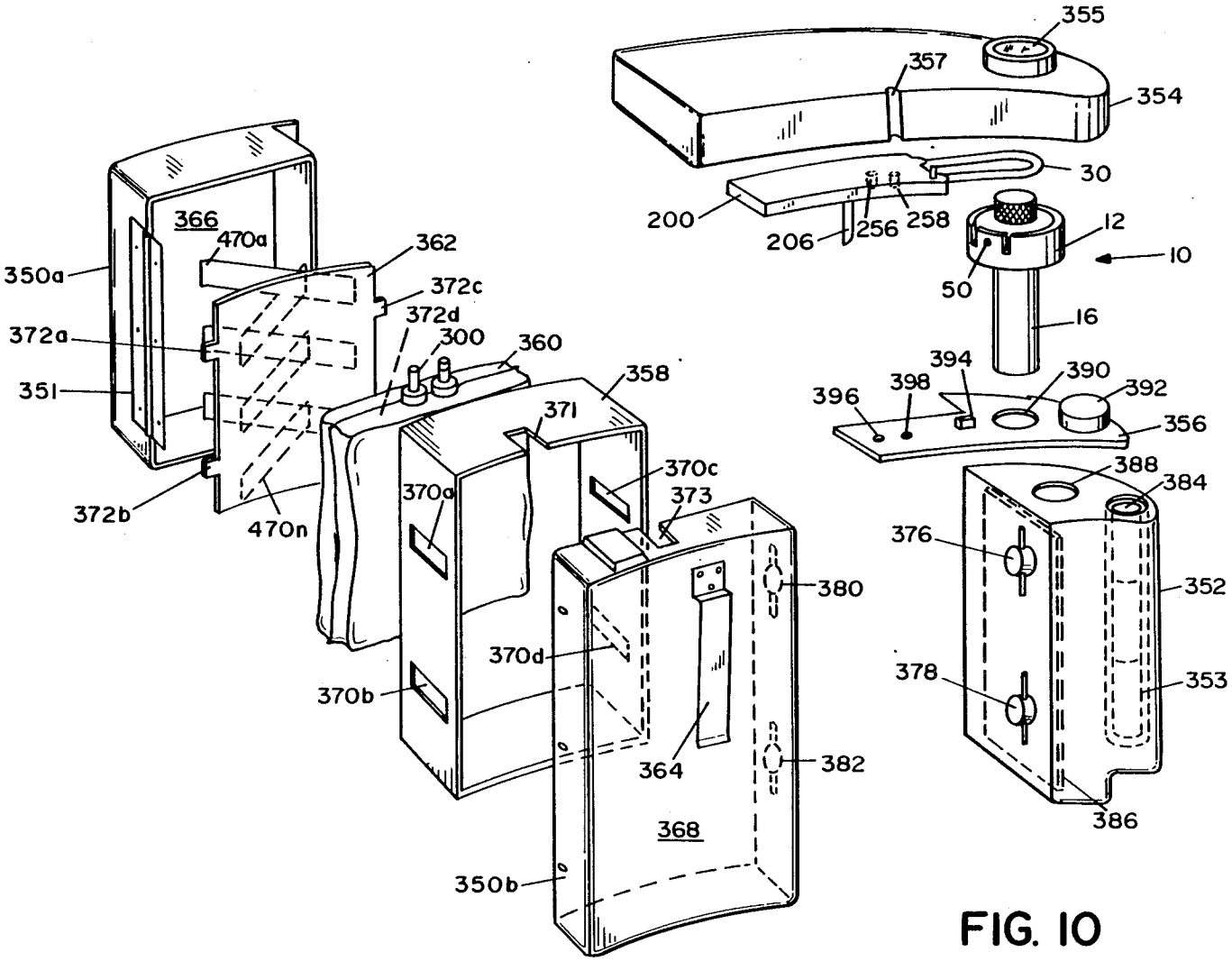
FIG. 10 illustrates an exploded view of the medicine bag housing and the electromechanical housing; and, FIG. 11 illustrates a cutaway top view of the medicine bag housing and attached electromechanical housing.

FIG. 9 illustrates a perspective view of the detachable recangular like medicine bag housing 350*a*–350*b* and attached electromechanical housing 352 with a geometrically configured cover 354 detached. The peristalic pump 10 and the filter 200 both secure onto an alignment bracket 356 to insure proper spacing and placement between the peristalic pump 10, the filter 200 and the low durometer tube 30. Bracket 356, pump 10 and filter 200 all secure to the electromechanical housing 352. A readily detachable two part IV medicine bag outer rectangular like housing 350*a* and 350*b* containing an inner medical bag housing 358, IV medicine bag 360 and spring plate 362 as shown in FIG. 10, readily attaches adjacent and onto the electromechanical housing 352 and its associated components to form a single unit. The medicine bag 360 and its container 350*a*–350*n* can be varying in dimension whether larger or smaller but still remain compatible for mating and attachment to the electromechanical housing 352 and its associated components. A cover 354 with a view port 355 and an exit tube slot 357 fits and secures over and about the top portions of the combined medicine bag housing 350*a* and 350*b* and electromechanical housing 352. A belt clip 364 secures on medicine bag housing 350*b* for convenient carriage upon the uses belt.

FIG. 10 illustrates an exploded view of the medicine bag housing 350*a* and 350*b*, and the electromechanical housing 352 and their associated components. Medicine bag housing 350*a* has an outer contoured surface 366 and medicine bag housing 350*b* has an inner contoured surface 368 to conform to the general shape of the users hip. A hinge 351 connects housing members 350*a* and 350*b*. Inner bag housing 358 fits within housing 350*a* and 350*b* and has 4 slots 370*a*–370*d* in its vertical sides and a rectangular probe cutout 371 positioned on its upper surface for accommodation of the medicine bag puncture spike 206. IV medicine bag 360 positions within the confines of the slotted contoured inner housing 358 and spring plate 362 with tabs 372*a*–372*d* engaged within slots 370*a*–370*d* respectively. A plurality of leaf springs 470*a* ∝ 470*n* position on a back surface of the spring plate 362 to apply pressure against the medicine bag 360 to provide a positive pressure of the infusate to the filter 200 and to the peristalic pump 10 when the medicine bag housing 350*a* is swung closed thus engaging against springs 470*a*–470*n*. A rectangular cutout 373 positions on the upper surface of medicine bag housing 350*b* for accommodation of the medicine bag puncturing spike 206.

Two quick connect fasteners 376 and 378 mount on the geometrically configured electromechanical housing 352 to provide for rapid securing in configured holes 380 and 382 shown in dashed lines on the outer medicine bag housing member 350*b*. A cylindrical battery chamber 352, battery package 384, an electronics control circuit board 386 and a motor receptacle hole 388 position in the electromechanical housing as illustrated. The motor 16 of the peristalic pump 10 positions and aligns in a hole 390 in geometrically configured bracket 356 and subseuquently in hole 388 in the electromechanical housing 352. Bracket 356 also includes a battery compartment cover 392, two filter alignment holes 396 and 398 and a speed sensing microswitch 394 which engages within the switch actuate hole 50 in-pump housing 12 to be activated by contact by plunger rollers 66, 68, and 70 during their rotation within the pump housing 12. Alignment pins 256 and 258 on the filter 200 engage within alignment holes 396 and 398 respectively within bracket 356 assuring proper alignment and spacing between the filter 200 and the peristalic pump 10 and also proper alignment of the low durometer tubeing 30 over and subsequently within tube groove 24 in pump housing 12. Geometrically configured cover 354 including pump viewing port 355 and exit tube slot 357 positions over the combination of the electromechanical housing 352 and the variable size detachable medicine bag housing 350*a* and 350*b* and their associated described component members. The spike 206 in the filter 200 punctures an outlet port 300 in the IV medicine bag 360 providing in conjunction with spring plate 362 pressure and infusate supply under positive pressure to the filter 200 and the inlet end 32 of low durometer tube 30 of the peristalic pump 10.

Figure 11:
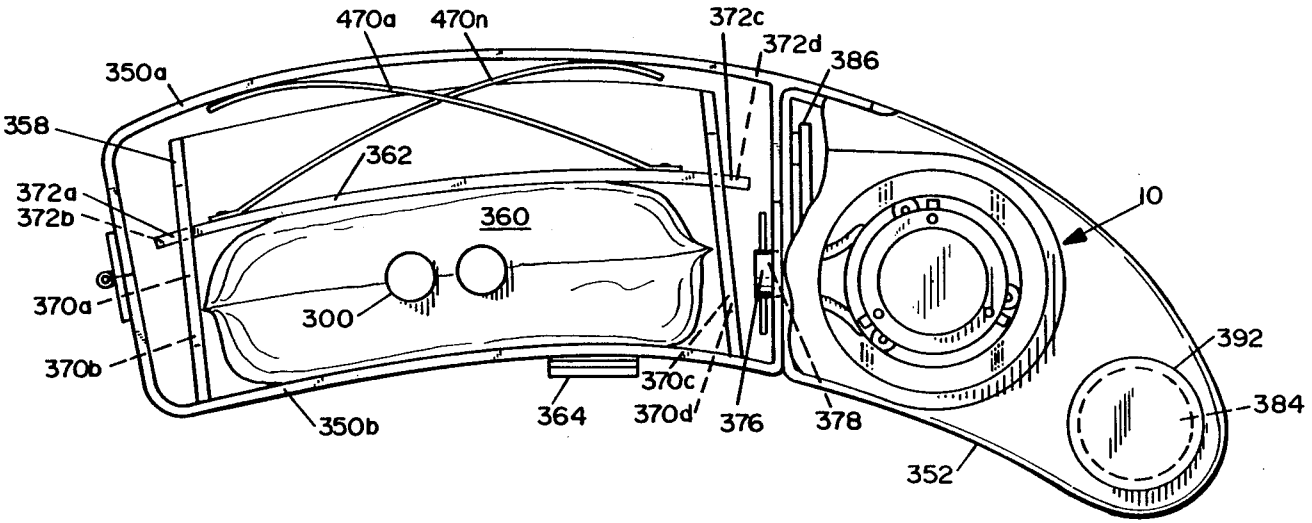

FIG. 11 illustrates a top cutaway view of the medicine bag housing 350*a* and 350*b* as attached to the electromechaincal housing 352. Springs 470*a*–470*n* on spring plate 362 apply force between medicine bag casing 350*a* and the spring plate 362 and against IV medicine bag 360 to provide infusate under positive pressure to the filter 200. Tabs 372*a*–372*d* on spring plate 362 engage within slots 370*a* and 370*b* in the inner housing 358 to allow for spring plate 362 movement and alignment with and aginst the IV medicine bag 360. Quick change connectors 376 and 378 engage within holes 380 and 382 in medicine bag housing 350*b* coupling the variable size medicine bag housing 350*a* and 350*b* and its internal components to the electromechanical housing 352 including peristalic pump 10 and filter 200.

MODE OF OPERATION

FIG. 4 best illustrates the mode of operation for the filtered low power peristaltic pump 10, the present invention in conjunction with FIGS. 4, 7 and 8 and other attendant FIGS. The medical solution filter system 200 is positioned next to and adjacent to the peristaltic pump 10 with the plastic pump loop 30, as illustrated in FIG. 5 placed generally above the pump 10 as depicted partially in dashed lines in FIG. 4. The inlet portion 32 of the plastic pump tube 30 is placed within the rear tube slot 26. Knurled actuating knob 126 is rotated manually in a clockwise direction turning the top cover 128 including radii tube fingers 130–134 to provide downward loading action against pump tube 30 by approximately positioned fingers 130–134 to maneuver the pump tube 30 into the inner annular tube groove 24 in pump housing 12. FIG. 4 illustrates tube feed finger 130 depressing the plastic pump tube 30 into annular tube groove 24. Manual rotation of knurled knob 126 continues until the outlet end 34 of tube 30 is in a position to be manually inserted into slot 28. At this point the tube 30 is fully loaded into the pump 10 and is subsequently held in place by overhead fingers 130–134, annular groove 24 and by action of the spring loaded plunger rollers 66–70 forcing the tube into annular tube goove 24. Sealed gear motor 16 provides rotary propulsion to turn the pump rotor 14, loading tool assembly 18 and associated component members. Plunger rollers 66–70 engage and ride within annular groove 24 when not actually engaged against pump tubing 30 as illustrated in FIG. 2. Spring loaded plungers 60–64 with plunger rollers 66–70 are oriented at an angle in the direction of rotation of the pump rotor 14 approximately 30° to the radii of the pump rotor 14 which greatly reduces the lateral forces that would occur between the plunger surfaces and the plunger slots 54–58 should the plunger and slots not be angularly mounted with respect to the radii of the pump rotor 14. As the rollered plungers 60–64 rotate in a clockwise fashion medical solution in the low durometer PVC tubing 30 is occluded at two points trapping and pumping the medical solution obtained in the tubing 30 between paired roller ends 68 and 70 or other sets of roller ends illustrated in FIG. 4. Normal "creeping" of the tube caused by rotary pushing motion of the rollers in the peristaltic pump is greatly reduced by having the roller plungers at an angle to the radii as less pressure of any kind is applied to the low durometer pump tube 30 to properly occlude a low durometer pump tube, hence less pushing of the tube occurs in general and specifically around the inner circumference of the pump housing. As the pump rotor 14 is electrically rotated medical solution or infusate is drawn from a medicine bag source through the filter inlet orifice 210 of the spike 206, through an upper spike orifice 212, laterally through cavity 220, through mesh screen filter 228, through and along longitudinal valleys 219*a*–219*n* and annular area 226 and to the pump 10 through the filter outlet orifice 242 as illustrated in FIG. 8. Hydrophobic filters 236 and 238 and respective air elimination ports 232 and 234 allow any air in cavity 220 to escape to ambient pressure. High durometer tubing 254 attaches to the outlet port 252 and delivers metered filtered infusate to the user.

I claim:

1. Drug dispensing pump comprising:

a. low power DC sealed motor with torqued gear ratio means;

b. pump head including a plurality of plungers connected to a shaft of said motor, each of said plungers supporting a roller bearing, each of said plungers spring loaded for accommodating variances of pump tubing, and each of said springs including a spring constant to fully occlude said pump tubing, each of said plungers mounted at an angle in said pump head for minimized friction, as well as low power at high infusion rates;

c. pump housing secured to a motor housing including a recessed slot for keeping said pump tubing in said pump head captured and providing a guide for said roller bearings; and, d. means for loading said pump tubing into said pump housing, said loading means including a disc affixed to said shaft, at least three fingers extending outwardly from said disc, and a knurled knob attached to said disc for manually rotating said shaft providing movement of said fingers whereby said loading means loads pump tubing into said pump head.

* * * * *